United States Patent [19]

Richardson

[11] Patent Number: 5,016,457

[45] Date of Patent: May 21, 1991

[54] METHOD OF FORMING METAL

[75] Inventor: Donald G. Richardson, Clontarf, Australia

[73] Assignee: Research Foundation Institute Pty. Limited, Australia

[21] Appl. No.: 444,144

[22] PCT Filed: Dec. 15, 1988

[86] PCT No.: PCT/AU88/00113

§ 371 Date: Dec. 8, 1989

§ 102(e) Date: Dec. 8, 1989

[87] PCT Pub. No.: WO88/07899

PCT Pub. Date: Oct. 20, 1988

[30] Foreign Application Priority Data

Apr. 15, 1987 [AU] Australia ..... PI1467

[51] Int. Cl.[5] ..... B21D 26/08

[52] U.S. Cl. ..... 72/56; 72/60; 72/430; 72/469; 72/706; 29/421.1; 29/421.2

[58] Field of Search ..... 72/56, 60, 706, 430, 72/469; 29/421.1, 421.2

[56] References Cited

U.S. PATENT DOCUMENTS

| | | | |
|---|---|---|---|
| 3,164,941 | 1/1965 | Johnson et al. | 29/463 |
| 3,238,753 | 3/1966 | Benatar et al. | 72/56 |
| 3,757,411 | 9/1973 | Umholtz | 29/416 |

FOREIGN PATENT DOCUMENTS

| | | | |
|---|---|---|---|
| 292112 | 1/1965 | Australia . | |
| 48827/79 | 7/1978 | Australia . | |
| 1777207 | 4/1971 | Fed. Rep. of Germany . | |
| 2397245 | 2/1979 | France . | |
| 0016160 | 10/1962 | Japan | 72/706 |
| 60-231530 | 4/1984 | Japan . | |
| 0115846 | 2/1946 | Sweden | 72/706 |
| 359893 | 8/1973 | U.S.S.R. . | |
| 1275629 | 5/1972 | United Kingdom . | |

*Primary Examiner*—David Jones

*Attorney, Agent, or Firm*—Leydig, Voit & Mayer

[57] ABSTRACT

A method and apparatus for the high energy rate forming of metal. A mold (11) of cage-like construction and of the shape to which the sheet metal is to be formed is lined with sheet metal and a liquid medium. A number of explosive charges are then placed at strategic locations within the liquid medium and detonated, causing deformation of the sheet metal and taking up by the metal of the shape defined by the mold. The mold is normally buried in a pit and supported therein during the deformation process. The cage-like structure of the mold enables air trapped between the sheet metal and the mold to escape during the deformation process. A method of forming boat hulls using this method is also disclosed.

12 Claims, 3 Drawing Sheets

METHOD OF FORMING METAL

TECHNICAL FIELD

The present invention relates to forming sheet metal into complex or compound shapes and particularly to the use of High Energy Rate Forming Techniques (HERF) in such a method.

BACKGROUND OF THE INVENTION

The high energy forming techniques of the type under discussion use high explosives to form metal. These techniques normally use water or some other suitable fluid as a transfer medium for the mechanical energy produced by the explosives. It has been found that liquids transmit the mechanical energy generated more efficiently than air. Normally the process happens in an open tank. The charge of high explosive detonates in the water a short distance from the sheet of metal to be formed. The explosion causes pressure waves to transmit momentum to the metal and force it against the surface of a hollow die by plastic deformation.

The detonation wave that passes through the exploding charge interacts with the water in two ways. First, it creates in a liquid a shock wave that strikes the metal. The detonation wave also forms a bubble of compressed gas in the water. The bubble expands and contracts repeatedly as it reflects off the surface of the workpiece and sides of the tank before venting into the air. Though the peak pressure produced by the oscillating bubble is perhaps only 10 to 20 % of the peak shock wave, the bubble's contribution to forming the metal is also significant. The gas pressure lasts longer than the initial shock wave.

Many different materials are used in the dies for explosive forming. Inexpensive dies of zinc alloys, epoxy resin, or even hard wood are tough enough to make small numbers of products with limited accuracy. Plaster is used for dies to be used only once. Using reinforced concrete dies, usually resin coated, is an efficient way to make large parts in small numbers. If a manufacturer wishes to make a lot of parts, then the dies must be made of ductile iron or special steels which can be reused many times.

The advantage of these techniques is that large complex or compound curved shapes can be formed without the need for heavy presses and the very expensive conventional metal dies.

These known techniques generally require a vacuum to be applied between the surface and the sheet metal prior to discharge of the explosive to remove the air from the space that the metal will take up. If this is not done, the speed with which the plastic deformation of the sheet metal takes place is so fast as to cause a compressed air bubble to form, resulting in the distortion of the finished sheet metal and prevention of it flowing into the desired shape of the female die. The application of such a vacuum is simple when molding small shapes. However, when large complex shapes are to be produced in a relatively rough mold it is difficult to produce the appropriate vacuum required because of the need to obtain a seal between the workpiece and the surface. This process also adds costs to the process. While the terms "die" and "mold" have been used interchangeably hereinbefore, hereinafter the term "mold" will be used to mean either a die or a mold.

DISCLOSURE OF THE INVENTION

The present invention seeks to overcome this problem and provide a method of using the known high energy rate forming techniques without the requirement of applying a vacuum between the mold and the sheet metal to be formed.

According to a first aspect, the present invention provides a method of forming sheet metal comprising the following steps:

- forming a female mold of a desired shape, the mold being of cage-like construction,
- placing the mold in a supporting means extending therearound,
- lining the mold with the sheet metal to be formed into the desired shape,
- filling the lined mold with a liquid medium,
- detonating an explosive charge at a predetermined location within the medium to cause deformation of the sheet metal and taking up by the sheet metal of the shape defined by the female die mold.

Preferably, in large formings the sheet metal to be formed may be constructed of several part formed pieces joined to form a single sheet. Preferably the sheets are joined by welding. Further if the sheet to be formed is not liquid impervious the mold is preferably lined inside said sheet metal with a liquid impervious material liner before filling with said liquid medium. Preferably, the mold is constructed of a plurality of longitudinally extending, closely spaced, steel ribs.

In a preferred method the inner surface of the mold is coated with a frangible material to provide a smooth surface to the mold by filling the spacings between the ribs, said frangible material being shattered during the deformation process and expelled with trapped air through the spacings between the ribs.

The invention will now be described in relation to its application to the production of molds for round bilge boats. However, it will be apparent to those skilled in the art that the invention is equally applicable to any application requiring formation of complex or compound curves in sheet metal and the invention is not limited to the particular application described.

Presently boats are built from sheet metal (mild steel and aluminium alloy) in a production line sense if they are small (less than 6 meters) and do not have complex or compound curves associated with the plating, i.e., less attractive "hard-chine" construction. Alternatively if the vessels are large (greater than 15 meters) and are 'one-off', rather than production line models, they are produced from individually shaped plates welded over a preformed set of boat frames, each panel being independently worked to impart the smooth compound curves necessary for the ultimate round bilge hull and then welded in place over the internal framework. These smooth lines often require the application of plastic putty to camouflage the imperfections in shape (e.g., distortion caused by welding plates), thus adding to cost of the final product. The labor cost and time of construction is substantially greater than the equivalent process of competing fiberglass manufacturers who can lay-up their materials in a female mold and produce uniform smooth hulls repetitively and less expensively. This cost difference is such that metal boats are not an economically viable proposition for round bilge production boats in the 6–15 meters, mass market, pleasure, or work boat range. Aluminium alloy hulls are even more difficult than steel due to the greater distortion that takes place on welding, requiring a higher level of skilled tradesman.

BRIEF DESCRIPTION OF DRAWINGS

A preferred embodiment of the invention, by way of example only, will now be described in relation to this particular application and with reference to the accompanying drawings in which.

PREFERRED EMBODIMENT OF THE INVENTION

Figure 1:
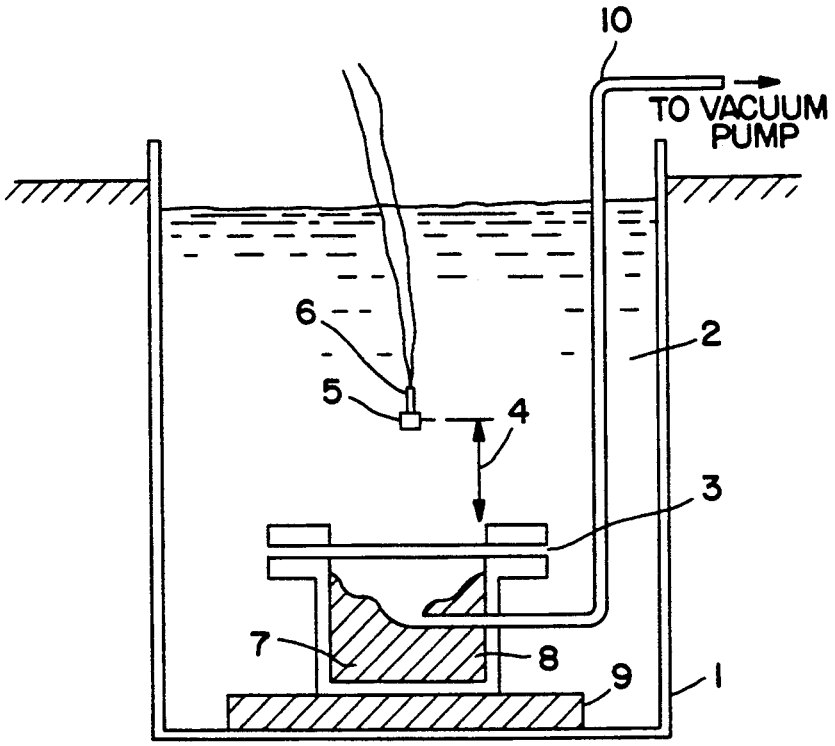
FIG. 1 PRIOR ART
FIG. 1 shows a pictorial representation of the prior art method of forming sheet metal into complex shapes using high energy rate forming techniques.

Referring to FIG. 1 of the drawings, tank 1 has mounted therein a mold 7. The mold is supported by container 8 resting on a base 9. The metal plate 3 to be formed is clamped across the opening to the mold 7. The space between the mold and the plate 3 is evacuated by means by vacuum pipe 10 extending from the surface of the mold to a vacuum pump external of the tank. The tank is filled with water 2 and the explosive 5 with associated detonator 6 is lowered to an appropriate stand-off distance 4 from the upper surface of the plate 3. On detonation of the explosive, the plate 3 is forced into contact with the mold surface and takes up the shape of the mold. The vacuum prevents the formation of air bubbles during the plastic deformation of the sheet metal and avoids distortion thereof.

Figure 2:
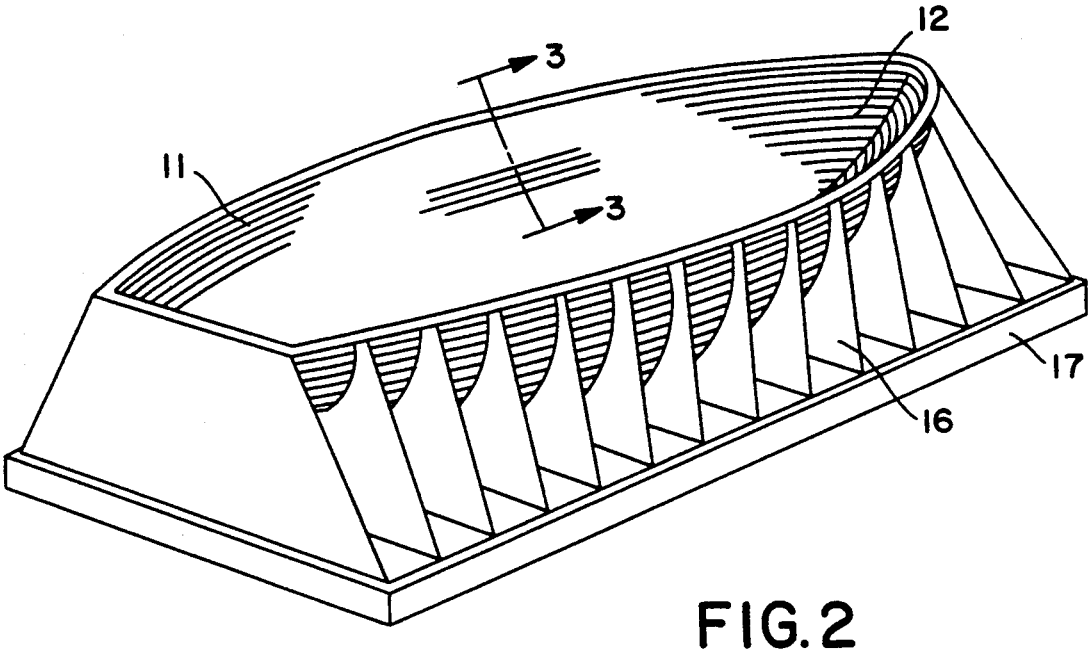
FIG. 2 shows a pictorial perspective representation of the mold according to the present invention.

Referring to FIG. 2 of the drawings, a female mold 11 of cage construction is shown. This mold consists of a plurality of longitudinally extending ribs 12 each spaced sufficiently from one another to allow air to pass through without permitting the deformation of the sheet metal 13 into the voids 15 between the ribs 12. The correct or desired shape is thus an envelope defined by the surfaces of the ribs 12 facing inside the mold. The ribs are supported in the correct shape by a plurality of upstanding webs 16 extending transversely of the mold and shaped to cradle the mold. The webs 16 are mounted on a heavy base 17 to provide a rigid robust construction. The ribs would be typically of 20mm×20mm cross sectored bright steel strip with approximately 2mm space between each metal rib. The mold is preferably of fully welded construction and designed structurally to withstand multiple uses. The mold would preferably be located in an isolated environment and mounted in a pit of suitable size and uniformly supported with gravel or blue metal (typically 14–20mm round) and sealed in place with a reinforced concrete cap.

A typical example of the application of the method according to the invention to application of the boat hull would be as follows:

1. Coating the inside of the mold cage with a smooth plaster of paris 'wash' 14 sufficient to yield a smooth shell of fragile nature. This plaster wash 14 is disposable and replaced between successive uses of the mold.

Figure 3:
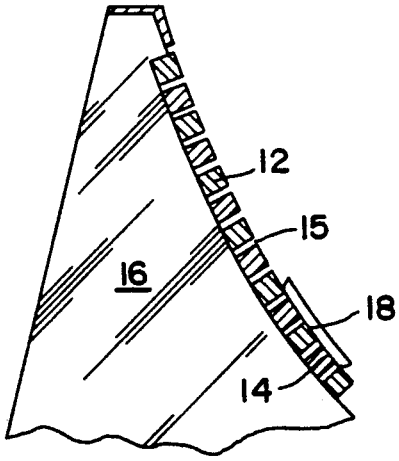
FIG. 3 shows a cross-sectional view taken on lines 3—3 of FIG. 2 illustrating a portion of the sheet panels and frangible material applied to the inner surface of the mold.
Figure 4:
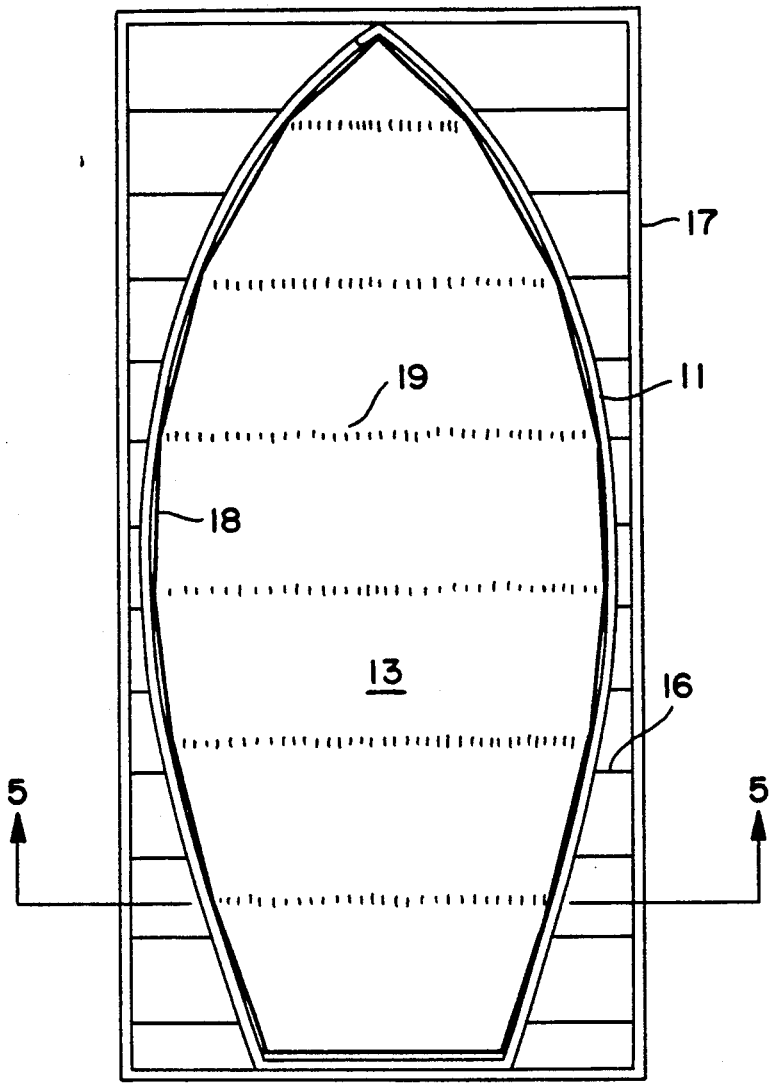
FIG. 4 shows a plan view of the mold with the preformed, curved panels welded in place.
Figure 5:
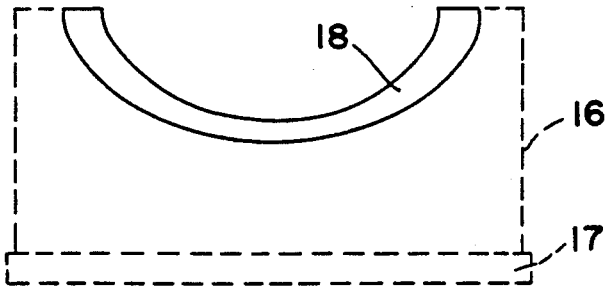
FIG. 5 shows an end elevation of one preformed panel prior to fitting.

2. Lining this die of suitable hull shape with preformed, planar curved, half or full width metal panels 18 (typically marine grade Aluminium Alloy [5083-H321]). These panels 18 may be typically between 1200–1400mm wide and of 5mm thickness in a 10 metre long boat. An example of a typical mold surface is depicted in FIG. 3;

3. Clamping the panels along the center and across the mold;

4. Internally welding the side seams 19 of the preformed, planar curved panels 18 using current technology for giving a sound joint in Aluminium plate; these side seams 19 are in contact with the mold surface during welding and suffer minimum stress in later forming;

5. Lining the sheet metal lay-up with a full sized polyethylene liner and filling with water (this step is only necessary if the prewelded shell to be formed into the mold shape is not waterproof);

6. Lowering a frame into the water onto which are mounted strategically placed and sized charges of high explosive (typically PETN (Pentaeythanol Tetranitrate) detonation cord-Cortex) connected in parallel to detonate instantaneously;

7. Detonation of charge, removal of water/plastic to access full formed boat shell; this process may be repeated if imperfections in the skin dictate a second application of the forming energy;

8. Frame-up the shell by fitting in metal stringer bulkheads, frames, floors by welding or other suitable fixing means while still supported in the mold and then welding on decking, as would a typical fiberglass producer of mass market, round bilge, pleasure boats. Decking may also be advantageously formed using the inventive method.

The use of the method according to the invention in the production of aluminium boat hulls enables economic, low volume production lines to be established. As inexpensive mild steel molds can be used the cost of these dies can be economically amortized over relatively low production volumes and, further, these dies can be readily modified to cope with hull design changes. The process provides the added advantage of requiring few skilled trademen to produce a uniform product of high dimensional accuracy and precision. Further, the use of production line techniques enables the application of other advanced manufacturing techniques such as robotics for welding or spray painting.

It will be apparent to those skilled in the art that the invention is not limited to the specific examples described and further embodiments and exemplifications of the invention are possible without departing from the spirit or scope of the invention described.

What is claimed is:

1. A method of forming sheet metal comprising the steps of:

forming a female mold of a desired shape, the mold being of cage-like construction having spaces therein, said cage-like construction defining an envelope of the desired shape, placing the mold in a supporting means extending therearound, lining the mold with the sheet metal to be formed into the desired shape, filling the lined mold with a liquid medium, and detonating an explosive charge at a predetermined location within the medium to cause deformation of the sheet metal, passage of air in a space between the mold and the sheet metal through the spaces, and taking up by the sheet metal of the shape defined by the envelope of the female mold.

2. A method of forming sheet metal according to claim 1 wherein the mold is constructed of a plurality of longitudinally extending, closely spaced ribs, said spaced being located between the ribs and being sufficient to allow for the expulsion of air trapped between the sheet metal and the mold during said step of detonation.

3. A method of forming sheet metal according to claim 1 wherein the sheet metal to be formed is constructed of several part formed pieces joined to form a single sheet.

4. A method of forming sheet metal according to claim 1 wherein said female mold is in the shape of a boat hull.

5. A method of forming sheet metal according to claim 2 wherein said female mold is in the shape of a boat hull.

6. A method of forming sheet metal according to claim 3 wherein said female mold is in the shape of a boat hull.

7. A method of forming sheet metal comprising the steps of:

forming a female mold of a desired shape, the die mold being of cage-like construction having spaces therein, said cage-like construction defining an envelope of said desired shape, placing the mold in a supporting means extending therearound, lining the mold with the sheet metal to be formed into the desired shape, filling the lined mold with a liquid medium, and detonating an explosive charge at a predetermined location within the medium to cause deformation of the sheet metal, passage of air in a space between the mold and the sheet metal through the spaces, and taking up by the sheet metal of the shape defined by the envelope of the female mold, and filling said spaces with a frangible material to temporarily provide a smooth surface to the mold prior to said step of lining the mold with sheet metal, the frangible material being shattered and expelled through the spaces together with the trapped air during said step of detonating, wherein the "cage like construction of the" mold is comprised of a plurality of longitudinally extending, closely spaces ribs, said spaces located between the ribs and being sufficient to allow for the expulsion of air trapped between the sheet metal and the mold during said step of detonation.

8. A method of forming sheet metal according to claim 7 wherein the frangible material is a coating of plaster of paris.

9. A method of forming sheet metal according to claim 7, wherein said female mold is in the shape of a boat hull;

10. A method of forming sheet metal according to claim 8 wherein said female mold is in the shape of a boat hull.

11. A method of forming sheet metal comprising the steps of:

forming a female mold of a desired shape, the die mold being of cage-like construction having spaces therein, said cage-like construction defining an envelope of said desired shape, placing the mold in a supporting means extending therearound, lining the mold with the sheet metal to be formed into the desired shape, filling the lined mold with a liquid medium, detonating an explosive charge at a predetermined location within the medium to cause deformation of the sheet metal, passage of air in a space between the mold and the sheet metal through the spaces, and taking up by the sheet metal of the shape defined by the envelope of the female mold, and lining the mold with a liquid impervious material liner before said step of filling.

12. A method of forming sheet metal according to claim 11 wherein said female mold is in the shape of a boat hull.

* * * * *

UNITED STATES PATENT AND TRADEMARK OFFICE

CERTIFICATE OF CORRECTION

PATENT NO. : 5,016,457

DATED : May 21, 1991

INVENTOR(S) : Donald G. Richardson

It is certified that error appears in the above-identified patent and that said Letters Patent is hereby corrected as shown below:

On the title page:

In item [86] PCT filing date, change "Dec. 15, 1988" to --April 15, 1988--.

Signed and Sealed this

Twenty-ninth Day of December, 1992

*Attest:*

DOUGLAS B. COMER

*Attesting Officer*

*Acting Commissioner of Patents and Trademarks*